US006575070B1

(12) United States Patent
Peyerl et al.

(10) Patent No.: US 6,575,070 B1
(45) Date of Patent: Jun. 10, 2003

(54) METHOD AND APPARATUS FOR CUTTING SHEET MATERIAL

(75) Inventors: Friedrich Peyerl, Albuquerque, NM (US); David S. Alvarez, Albuquerque, NM (US); Paul S. Manicke, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/495,266

(22) Filed: Jan. 31, 2000

(51) Int. Cl.[7] ..... B26D 1/547
(52) U.S. Cl. ..... 83/651.1; 83/614
(58) Field of Search ..... 83/651.1, 614, 83/171, 932; 425/296, 297, 308, 315

(56) References Cited

U.S. PATENT DOCUMENTS

| | | | | | |
|---|---|---|---|---|---|
| 1,077,226 | A | * | 10/1913 | King | 83/155 |
| 2,987,598 | A | * | 6/1961 | Chace et al. | 83/171 |
| 3,055,251 | A | * | 9/1962 | Krikorian | 83/613 |
| 3,788,178 | A | * | 1/1974 | Pantel | 83/171 |
| 3,821,916 | A | * | 7/1974 | Ricci et al. | 83/651.1 |
| 3,838,621 | A | * | 10/1974 | Keck | 83/651.1 |
| 4,018,116 | A | * | 4/1977 | Treffner et al. | 83/651.1 |
| 4,419,065 | A | * | 12/1983 | Cox | 425/301 |
| 5,445,053 | A | * | 8/1995 | Kallner | 83/651.1 |
| 5,666,872 | A | * | 9/1997 | McDonald et al. | 83/171 |
| 6,041,988 | A | * | 3/2000 | Shapiro | 83/614 |
| 6,070,508 | A | * | 6/2000 | Grimme | 83/651.1 |
| 6,109,153 | A | * | 8/2000 | Dueck | 83/487 |
| 6,138,546 | A | * | 10/2000 | Hursey | 83/614 |

* cited by examiner

*Primary Examiner*—Allan N. Shoap
*Assistant Examiner*—Thomas J Druan, Jr.
(74) *Attorney, Agent, or Firm*—V. G. Ramaswamy; Sonnenschein Nath & Rosenthal

(57) ABSTRACT

Apparatus for cutting a sheet of material along a preselected line. The apparatus includes a table having an upper surface sized and shaped for receiving the sheet of material. In addition, the apparatus includes a wire positionable adjacent the upper surface of the table and generally vertically below the preselected line on the sheet of material when the sheet of material is received by the upper surface of the table. Further, the apparatus includes an elongate guide positionable above the sheet of material when the sheet is received by the upper surface of the table for holding the sheet of material in position with respect to the wire and the upper surface of the table. The apparatus also includes a device engageable with the wire for pulling the wire upward through the sheet of material to cut the sheet of material along the preselected line.

10 Claims, 6 Drawing Sheets

METHOD AND APPARATUS FOR CUTTING SHEET MATERIAL

BACKGROUND OF THE INVENTION

The present invention relates generally to a method and apparatus for cutting sheets of material such as foam adhesive material.

Often, composite components such as those used in gas turbine engines are made by assembling sub-components such as sheets of carbon reinforced resins and/or more complex structures in predetermined orientations. Sheets of adhesive material are applied to the sub-components and activated to form the composite components. Frequently, the sheets of adhesive material are a foam or film epoxy material having paper backing covering each face prior to use.

Conventionally, a knife and a straight edge are used to cut the sheets of adhesive. However, as the sheets are cut, the technician simultaneously must hold the straight edge in place on the sheet of material, hold the knife against the straight edge and press the knife against the sheet of adhesive with sufficient force to cut the adhesive. If the knife becomes spaced from the straight edge or the straight edge moves, the cut will not be straight. Further, this procedure sometimes produces slivers of the adhesive, slivers of the paper backing, and/or slivers of the straight edge. If the slivers are not found and removed, they can become embedded in the components. In addition, the knife must be periodically sharpened or replaced thereby adding cost to the components.

SUMMARY OF THE INVENTION

Among the several features of the present invention may be noted the provision of an apparatus for cutting a sheet of material along a preselected line. The apparatus includes a table having an upper surface sized and shaped for receiving the sheet of material. In addition, the apparatus includes a wire positionable adjacent the upper surface of the table and generally vertically below the preselected line on the sheet of material when the sheet of material is received by the upper surface of the table. Further, the apparatus includes an elongate guide positionable above the sheet of material when the sheet is received by the upper surface of the table for holding the sheet of material in position with respect to the wire and the upper surface of the table. The apparatus also includes a device engageable with the wire for pulling the wire upward through the sheet of material to cut the sheet of material along the preselected line.

In another aspect, apparatus of the present invention includes a table and an elongate guide positionable above the sheet of material when the sheet is received by the table. The guide has a track extending longitudinally along the guide. Further, the guide has two inward facing edges spaced by a gap having a generally constant width positioned generally vertically above the preselected line on the sheet of material when the guide is positioned above the sheet of material and the sheet is received by the table. In addition, the apparatus includes a wire positionable adjacent the upper surface of the table and below the sheet of material when the sheet of material is received by the upper surface of the table. The wire is positioned laterally between the edges and vertically below the gap of the guide when the guide is positioned above the sheet of material. The apparatus also includes a shuttle moveably engaging the guide track for pulling the wire upward through the sheet of material and through the gap in the guide to cut the sheet of material along the preselected line.

Moreover, the present invention includes a method of cutting a sheet of material. The method includes positioning an elongate guide adjacent a first face of a sheet of material and positioning a wire adjacent a second face of the sheet of material opposite the first face. Further the method includes the step of pulling the wire through the sheet of material and through the gap between the spaced edges of the elongate guide to cut the sheet of material.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
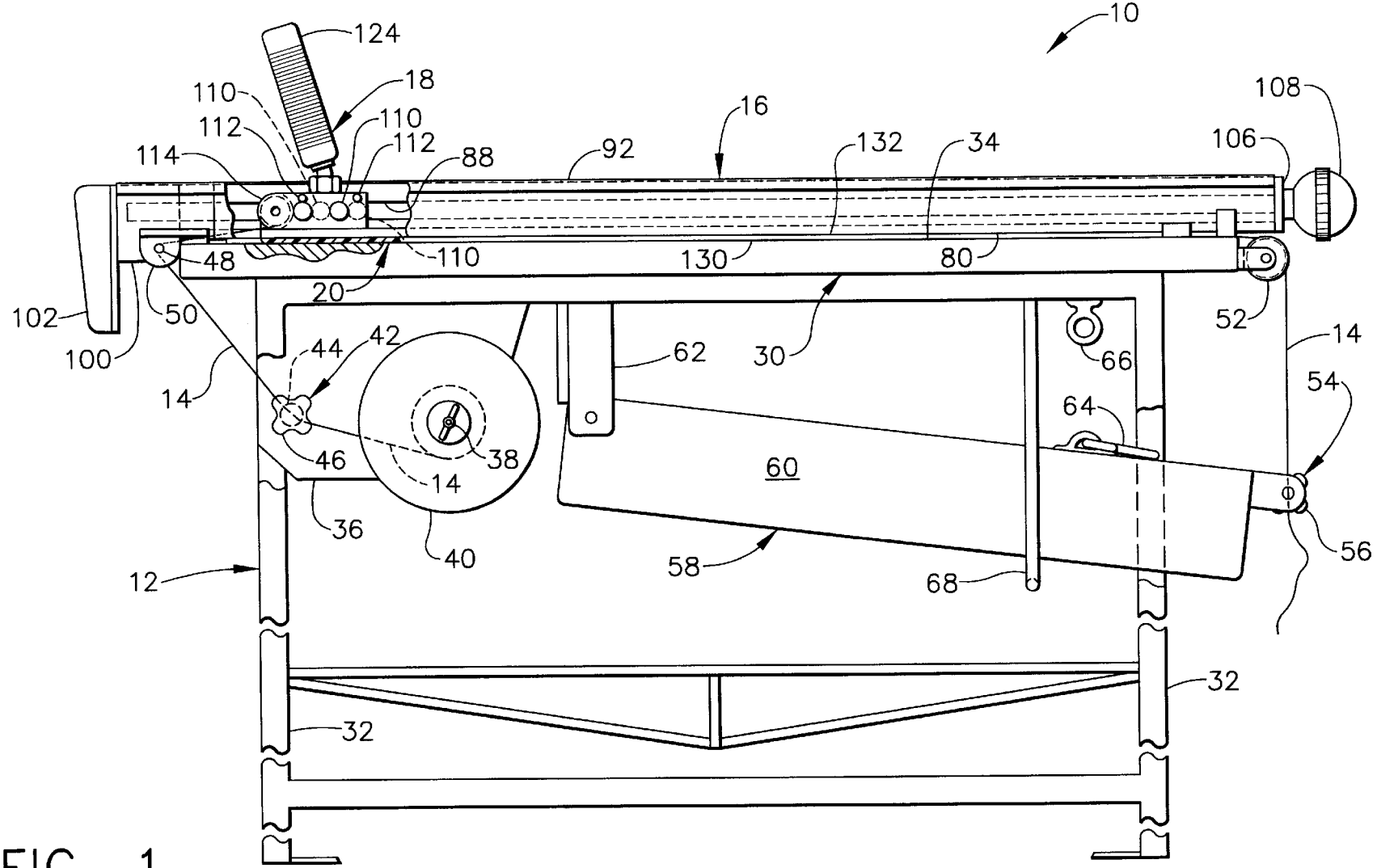
FIG. 1 is side elevation of an apparatus of the present invention.

Referring now to the drawings and in particular to FIG. 1, apparatus of the present invention is designated in its entirety by the reference number 10. Generally, the apparatus 10 includes a table (generally designated by 12), a wire 14, an elongate guide (generally designated by 16) and a shuttle (generally designated by 18). As will be explained in further detail below, the apparatus 10 pulls the wire 14 through a sheet of material, generally designated by 20, to cut the sheet of material along a preselected line 22 (shown in phantom in FIG. 2). Although the apparatus 10 of the preferred embodiment is used to cut sheets of foam or film adhesive material, it is envisioned the apparatus could be used to cut sheets of material such as waxes, plastics, resins, elastomers, paper and food products without departing from the scope of the present invention.

Figure 2:
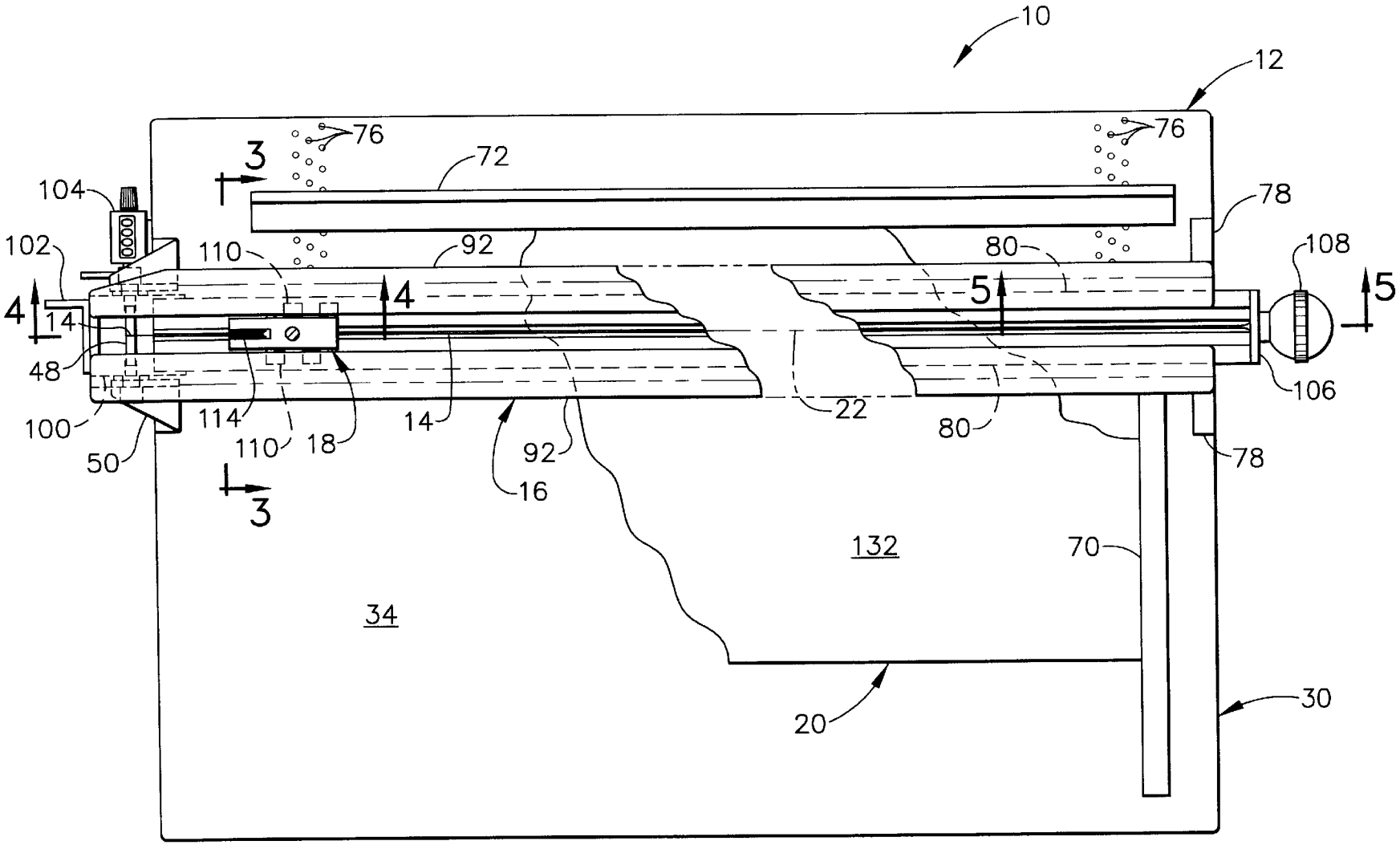
FIG. 2 is a top plan of the apparatus.

As illustrated in FIG. 1, the table 12 has a top, generally designated by 30, supported by four legs 32 (only two of which are visible in FIG. 1). As shown in FIG. 2, the top has a planar upper surface 34 sized and shaped for receiving the sheet of material 20. Although the upper surface 34 may have other dimensions without departing from the scope of the present invention, in one preferred embodiment used for cutting sheets of material 20 which are about 26 inches by about 12 inches, the upper surface is about 29 inches by about 20 inches.

A mount 36 is provided below the table top 30. The mount 36 includes a conventional spool support 38 for holding a spool 40 of wire 14 and a clamp, generally designated by 42, for attaching the wire to the table 12. The clamp 42 includes a internally threaded cylinder 44 having a hole (not shown) extending diametrically through the cylinder. The wire 14 is unwound from the spool 40 and threaded through the hole in the cylinder 44. A screw 46 is threaded into the cylinder 44 so it abuts the wire 14 to hold the wire in place. When a sufficient length of wire 14 is unwound from the spool 40 as will be explained below, the screw 46 is tightened to clamp a first (trailing) end of the wire in position with respect to the table 12. The wire 14 extends upward from the clamp 42 and partially around a pin 48 extending through a bracket 50 attached to the table top 30. From the pin 48, the wire 14 extends through the shuttle 18. The wire 14 extends from the shuttle 18 underneath the sheet 20 and partially around a pulley 52 mounted on the table top 30 to a clamp, generally designated by 54, similar to the clamp 42 adjacent the spool 40. The clamp 54 comprises an internally threaded cylinder (not shown) similar to the cylinder 44 and a screw 56 similar to screw 46 for clamping a second (leading) end of the wire 14 to a tensioning device, generally designated by 58.

The tensioning device generally includes a weight 60 which is pivotally attached to a bracket 62 extending downward from the table top 30. As the weight 60 is biased down by gravity, it pulls the leading end of the wire 14 clamped to the weight and tensions the wire so the wire is positioned adjacent the upper surface 34 of the table 12 and generally vertically below the preselected line 22 on the sheet of material 20 when the sheet of material is received by the upper surface of the table. Although the weight 60 may be heavier or lighter without departing from the scope of the present invention, the weight of the preferred embodiment is about nine pounds. Further, although a weight 60 is used to tension the wire 14 in the preferred embodiment, those skilled in the art will appreciate that other conventional tensioning devices may be used without departing from the scope of the present invention. A hook 64 is provided on the weight 60 for attaching the weight to an eye 66 mounted on the table 12. Thus, the weight 60 may be lifted and supported to remove tension from the wire 14 when adjusting the wire in the clamps 42, 54. Further, a U-shaped safety bar 68 mounted on the table 12 extends around the weight 60 to prevent the weight from swinging downward in the event the wire 14 breaks.

Figure 3:
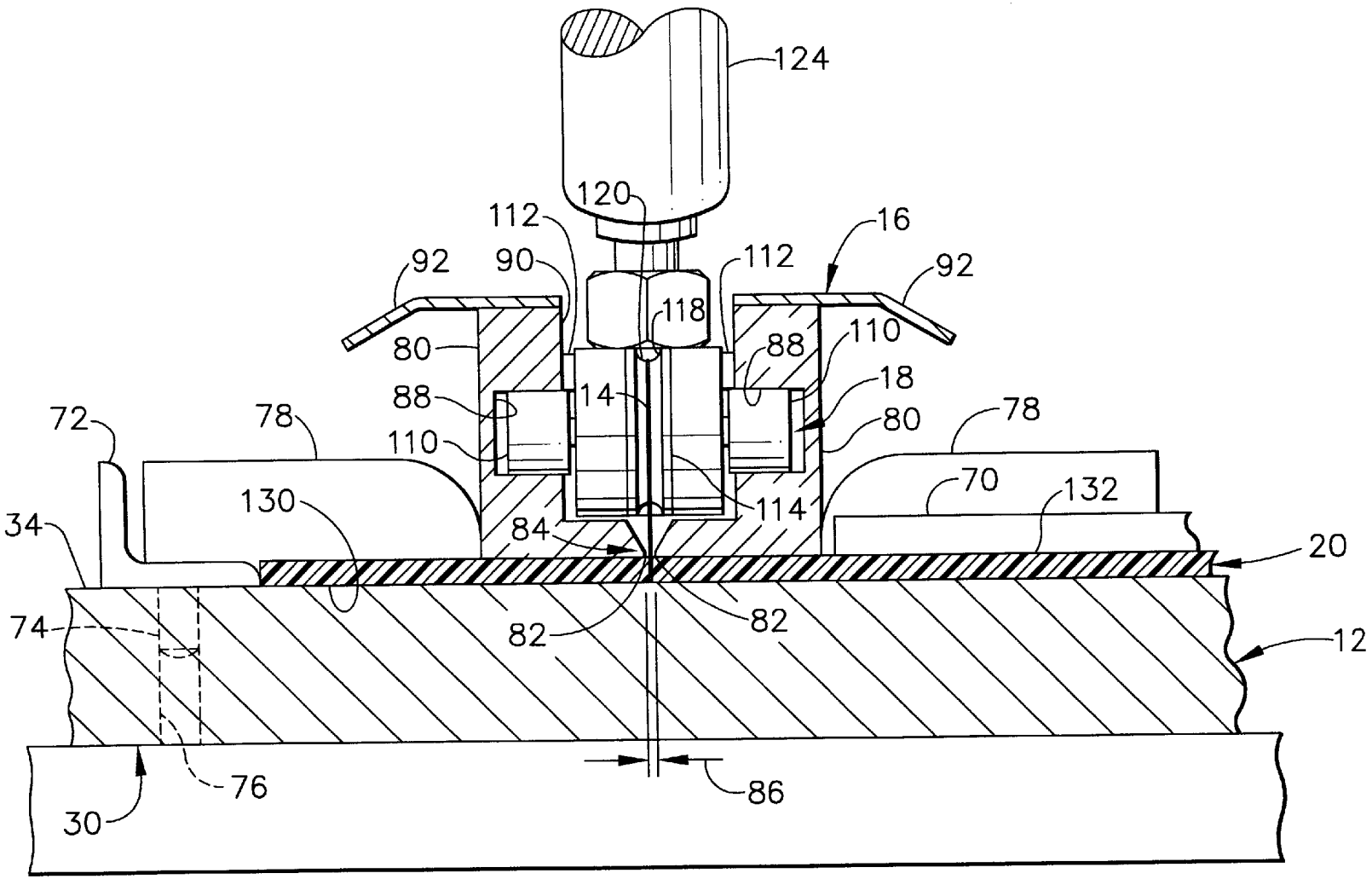
FIG. 3 is a cross section of the apparatus taken in the plane of line 3—3 of FIG. 2.

As illustrated in FIG. 2, two fences 70, 72 are mounted on the table top 30 for aligning the sheet of material 20 with respect to the guide 16 to cut the sheet of material along the preselected line 22. The first fence 70 is fastened to the table top 30 with fasteners (not shown). As illustrated in FIG. 3, the second fence 72 includes pins 74 which engage holes 76 in the table top 30 for holding the fence in a preselected position perpendicular to the first fence 70. As shown in FIG. 2, the table top 30 has a series of holes 76 for adjusting the position of the second fence 72 thereby changing the finished width of the sheets of material 20 after being cut. In addition, it is envisioned that indicia (not shown) may be inscribed on the upper surface 34 of the table 12 to aid in determining the finished width of the sheets of material 20 after being cut. Further, blocks 78 are provided on each side of the guide 16 for ensuring the guide remains parallel to the second fence 72.

As further illustrated in FIG. 1, the wire 14 extends adjacent the upper surface 34 of the table 12 and below the sheet of material 20 when the sheet of material is received by the upper surface of the table. Although the wire 14 may have other dimensions and be made of other materials without departing from the scope of the present invention, in one preferred embodiment the wire has a nominal diameter of about 0.011 inches and is made of ASTM A228 material. As will be explained in further detail below, the wire 14 is pulled upward away from the upper surface 34 of the table 12 and through the sheet of material 20 to cut the sheet of material along the preselected line 22.

As illustrated in FIG. 3, the guide 16 includes two elongate members 80 having L-shaped cross sections. The horizontal leg of each member 80 has a lower edge 82 which faces a corresponding lower edge on the other member.

The facing edges 82 are spaced by a gap, generally designated by 84, having a generally constant width 86. Although the gap 84 may have other widths 86 without departing from the scope of the present invention, in one preferred embodiment the gap has a width of about 0.040 inches. Further, the gap 84 is positioned directly vertically above the preselected line 22 on the sheet of material 20 when the guide 16 is positioned above the sheet of material and the sheet is received by the upper surface 34 of the table 12. Each of the members 80 includes a groove 88 opening inward toward a channel 90 formed between the vertical legs of the members. The grooves 88 and channel 90 form a track extending longitudinally along the guide 16 for guiding the shuttle 18 along the guide. Although the members 80 may be made of other materials without departing from the scope of the present invention, in one preferred embodiment the members are made of aluminum. A stiffening plate 92 is attached to the upper end of each member 80 for stiffening the respective member against lateral deflections.

Figure 4:
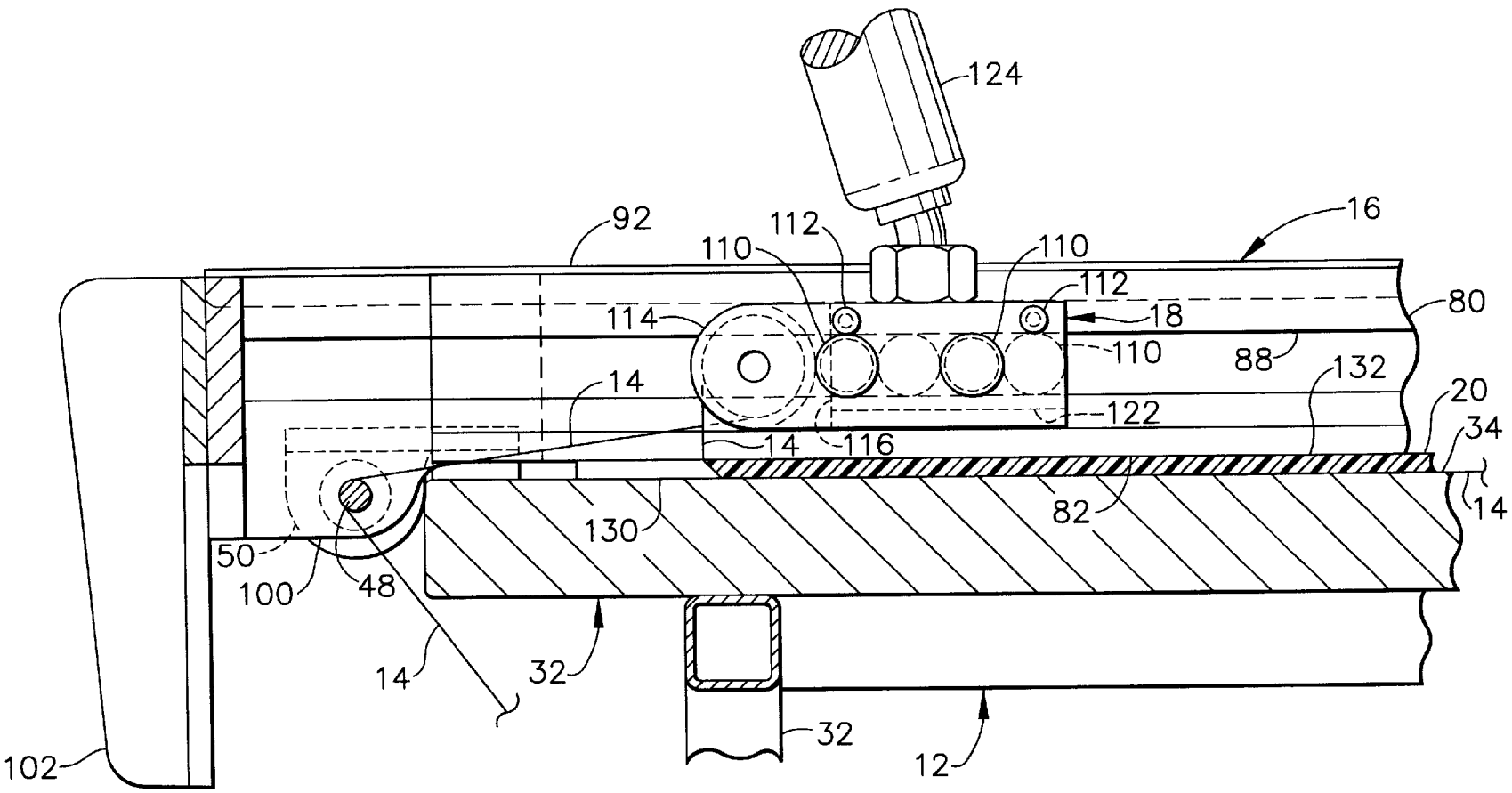
FIG. 4 is a cross section of the apparatus taken in the plane of line 4—4 of FIG. 2.
Figure 5:
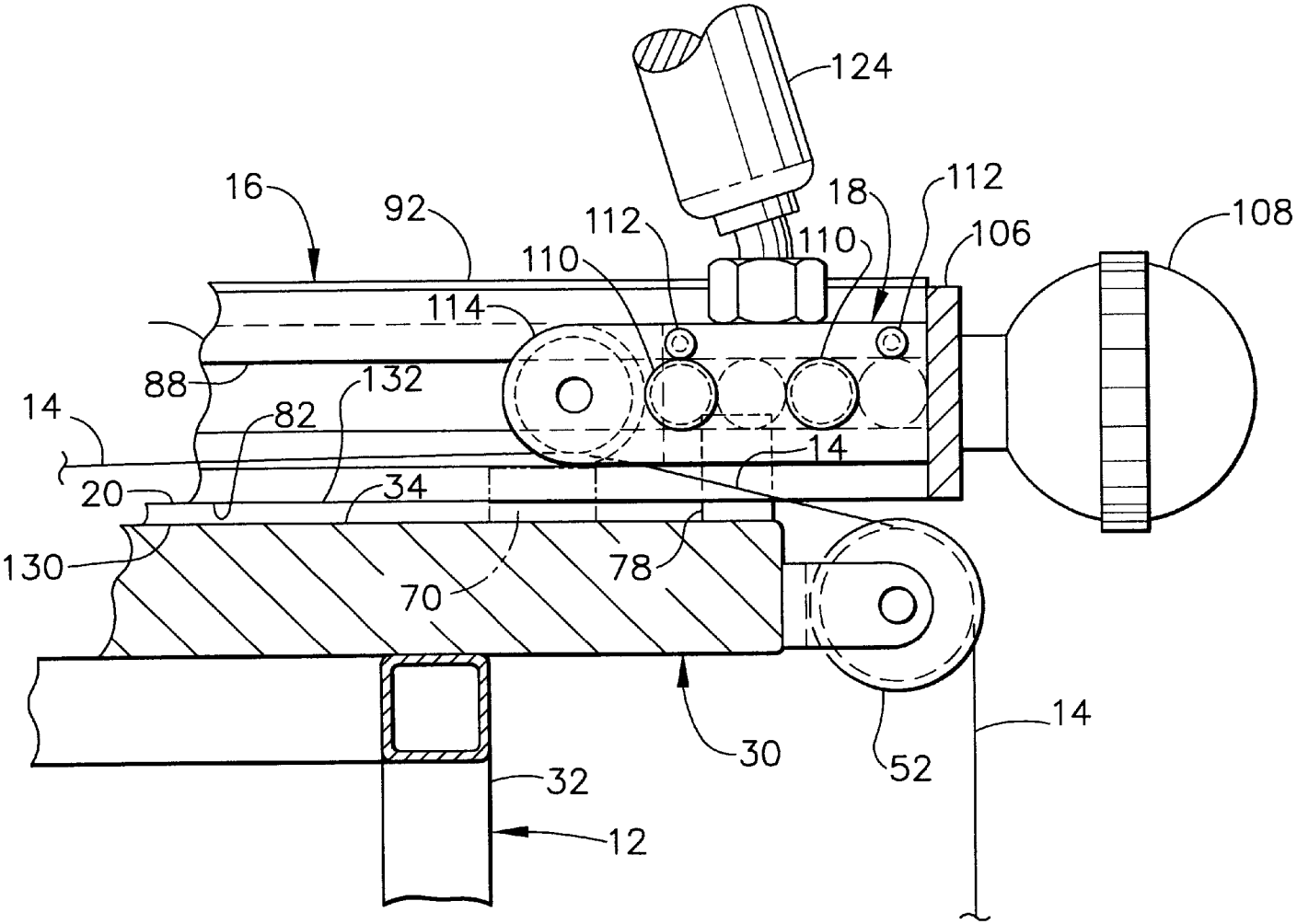
FIG. 5 is a cross section of the apparatus taken in the plane of line 5—5 of FIG. 2.
Figure 6:
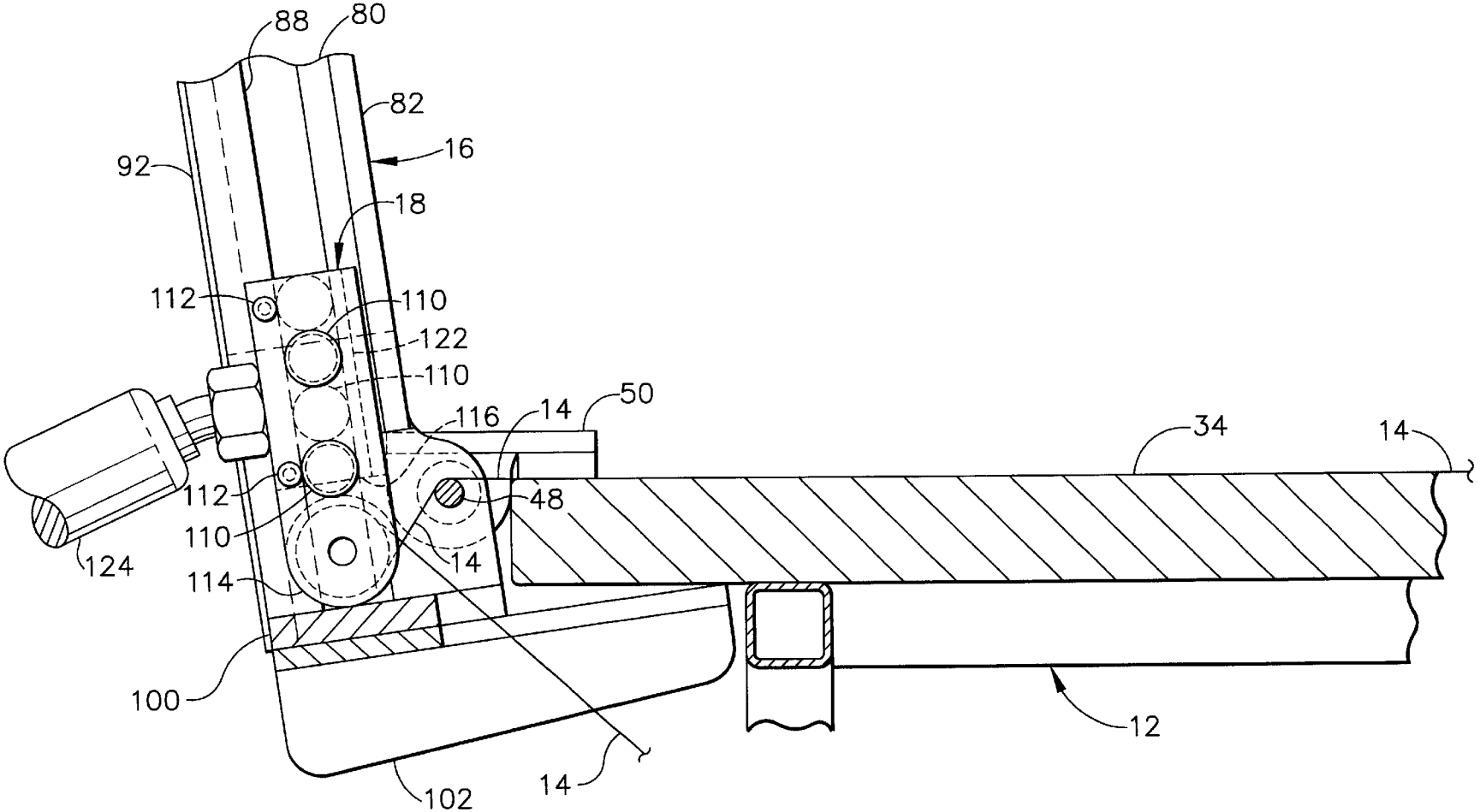
FIG. 6 is a cross section of the apparatus similar to FIG. 4 but showing a guide in a raised position.

As illustrated in FIG. 4, a bracket 100 connects one pair of adjacent ends of the guide members 80. The bracket 100 is pivotally connected to the table top 30 by the pin 48 extending through the bracket 50 so the guide 16 is pivotable between a raised position as shown in FIG. 6 in which the guide is spaced from the upper surface 34 of the table 12 for positioning the sheet of material 20 on if the upper surface of the table and a lowered position as shown in FIG. 4 in which the gap defined by the edges of the guide is positioned generally vertically above the wire 14. Thus, when the guide 16 is in the lower position, it holds the sheet of material 20 in position with respect to both the wire 14 and the upper surface 34 of the table 12. In addition, a stop 102 is provided on the bracket 100 to limit the rotational travel (i.e., counterclockwise rotation) of the guide 16 as shown in FIG. 6. Still further, as shown in FIG. 2, a conventional counter mechanism 104 is attached to the bracket 50 on the table 12 for counting each time the guide 16 is raised to load a sheet of material 20 on the table 12. As illustrated in FIG. 5, a fitting 106 connects the adjacent ends of each guide member 80 opposite the bracket 100. A knob 108 is provided on the fitting 106 to provide a handle when moving the guide between its raised and lowered positions.

As further illustrated in FIG. 4, the shuttle 18 has four guide rollers 110 which roll in the grooves 88 in the guide members 80 to direct the shuttle along the guide 16 and above the preselected line 22 on the sheet of material 20. In addition, two wear pads 112 are provided on each side of the shuttle 18 for ensuring the shuttle remains centered in the track formed by the grooves 88 and the channel 90. The shuttle 18 also includes a rotatably mounted sheave 114 in a vertical slot 116 extending in from one end of the shuttle. The sheave 114 guides the wire 14 upward through the sheet of material 20 and through the gap 84 to cut the sheet of material along the preselected line 22 as will be explained below. Thus, the shuttle 18 forms a device which engages the wire 14 for pulling the wire upward through the sheet of material 20 to cut the sheet of material along the preselected line 22. The wire 14 extending from the pin 48 wraps almost entirely around a groove 118 provided in the sheave 114 and then extends to the pulley 52 as explained above. Moreover, although the groove 118 may have other shapes without departing from the scope of the present invention, in the preferred embodiment the groove has a rounded bottom 120 for guiding the wire as shown in FIG. 3. Initial testing has indicated a groove 118 having a rounded bottom 120 is less likely to become gummed up by adhesive from the sheet of material 20 than is a groove having a V-shaped bottom.

Although the sheave 114 may be made of other materials without departing from the scope of the present invention, in one preferred embodiment the sheave is made of tetrafluoroethylene. As illustrated in FIG. 4, a horizontal slot 122 is provided along the bottom of the shuttle 18 for maintaining sufficient clearance between the shuttle and the wire 14. Further, the shuttle 18 includes a handle grip 124 for moving the shuttle along the channel 90. Preferably, the grip 124 is angled so it may be grasped more easily.

To load the apparatus 10, the guide 16 is raised to the position shown in FIG. 6 and a sheet of material 20 is positioned over the wire 14 and on the upper surface 34 of the table top 30 so the wire is positioned adjacent a lower face 130 (FIG. 4) of the sheet of material. Further, the sheet of material 20 is positioned so edges of the sheet of material 20 abut the corresponding fences 70, 72. As explained above, the fence 72 may be suitably positioned on the table top 30 by placing the pins 74 in the appropriate holes 76 in the table top so the sheet of material 20 will be cut to the desired size. Once the sheet of material 20 is in position, the guide 16 is lowered to the position shown in FIG. 1 so the guide is adjacent an upper face 132 (FIG. 4) of the sheet of material. Then the shuttle 18 is moved from the position shown in FIG. 4 toward the fence 70 to the position shown in FIG. 5. As the shuttle 18 moves along the guide, the sheave 114 rotates and pulls the wire 14 upward through the sheet of material 20, past the edges 82 of the elongate guide 16 and through the gap 84 to cut the sheet of material along the preselected line 22. After the sheet 20 is cut along the preselected line 22, the shuttle 18 is returned to the position shown in FIG. 4 before the guide 16 is raised to remove the resulting pieces of sheet material. When the guide 16 is raised, the counter mechanism 104 automatically increments.

Each time the apparatus 10 is used, active portions of the wire 14 are stressed. To prevent the wire 14 from failing due to fatigue, the wire is advanced after some predetermined number of cuts (e.g., 75 cuts) are made.

To advance the wire 14, the weight 60 is lifted and the hook 64 is inserted in the eye 66 to take tension off of the wire. The clamps 42, 54 are loosened and the wire 14 is advanced until an unused portion extends over the table top 30. Once the wire is advanced, the clamps 42, 54 are re-tightened, the counter mechanism is reset to zero and the weight 60 is unhooked to tension the wire.

Although the apparatus 10 described above is manually operated to cut the sheet of material 20 and to periodically advance the wire 14, it is envisioned that one or both of these procedures may be motorized and/or automated without departing from the scope of the present invention. Further, although the apparatus 10 described above has only one wire 14, it is envisioned that more than one wires may be used to make more than one simultaneous cuts without departing from the scope of the present invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for cutting a sheet of material along a preselected line, the apparatus comprising:

a table having an upper surface sized and shaped for receiving the sheet of material;

a wire positionable adjacent the upper surface of the table and generally vertically below the preselected line on the sheet of material when the sheet of material is received by the upper surface of the table;

an elongate guide positionable above the sheet of material and in engagement with the sheet when the sheet is received by the upper surface of the table for holding the sheet of material with respect to the wire and the upper surface of the table; and a device at least partially positioned above the sheet of material when the sheet is received by the upper surface of the table and engageable with the wire for pulling the wire upward through the sheet of material to cut the sheet of material along the preselected line, wherein the device includes a shuttle adapted to pull the wire upward through the sheet of material to cut the sheet of material and the shuttle includes a guide roller, and wherein the guide has a track sized and shaped for receiving the guide roller to direct the shuttle along the guide and above the preselected line on the sheet of material.

2. Apparatus for cutting a sheet of material along a preselected line, the apparatus comprising:

a table having an upper surface sized and shaped for receiving the sheet of material;

a wire positionable adjacent the upper surface of the table and generally vertically below the preselected line on the sheet of material when the sheet of material is received by the upper surface of the table;

an elongate guide positionable above the sheet of material and in engagement with the sheet when the sheet is received by the upper surface of the table for holding the sheet of material in position with respect to the wire and the upper surface of the table; and a device at least partially positioned above the sheet of material when the sheet is received by the upper surface of the table and engageable with the wire for pulling the wire upward through the sheet of material to cut the sheet of material along the preselected line, wherein the table includes a shuttle adapted to pull the wire upward through the sheet of material to cut the sheet of material, and wherein the shuttle includes a rotatably mounted sheave for guiding the wire upward through the sheet of material to cut the sheet of material.

3. Apparatus as set forth in claim 2 wherein the sheave has a groove with a rounded bottom extending around the sheave for guiding the wire.

4. Apparatus for cutting a sheet of material along a preselected line, the apparatus comprising:

a table having an upper surface sized and shaped for receiving the sheet of material;

a wire positionable adjacent the upper surface of the table and generally vertically below the preselected line on the sheet of material when the sheet of material is received by the upper surface of the table;

an elongate guide positionable above the sheet of material and in engagement with the sheet when the sheet is received by the upper surface of the table for holding the sheet of material in position with respect to the wire and the upper surface of the table; and a device at least partially positioned above the sheet of material when the sheet is received by the upper surface of the table and engageable with the wire for pulling the wire upward through the sheet of material to cut the sheet of material along the preselected line;

wherein the table includes a clamp for attaching a first end of the wire to the table, and a tensioning device for pulling a second end of the wire opposite the first end to tension the wire.

5. Apparatus as set forth in claim 4 wherein the tensioning device includes a weight mounted on the table and attached to said second end of the wire to tension the wire as the weight is biased downward by gravity.

6. Apparatus for cutting a sheet of material along a preselected line, the apparatus comprising:

a table having an upper surface sized and shaped for receiving the sheet of material;

a wire positionable adjacent the upper surface of the table and generally vertically below the preselected line on the sheet of material when the sheet of material is received by the upper surface of the table;

an elongate guide positionable above the sheet of material and in engagement with the sheet when the sheet is received by the upper surface of the table for holding the sheet of material in position with respect to the wire and the upper surface of the table, the guide being pivotable between a raised position in which the guide is spaced from the upper surface of the table for positioning the sheet of material on the upper surface of the table and a lowered position in which the guide is positioned generally vertically above the wire; and a device at least partially positioned above the sheet of material when the sheet is received by the upper surface of the table and engageable with the wire for pulling the wire upward through the sheet of material to cut the sheet of material along the preselected line.

7. Apparatus for cutting a sheet of material along a preselected line, the apparatus comprising:

a table having an upper surface sized and shaped for receiving the sheet of material;

an elongate guide positionable above the sheet of material when the sheet is received by the upper surface of the table, the guide having a track extending longitudinally along the guide and two inward facing edges spaced by a gap having a generally constant width positioned generally vertically above the preselected line on the sheet of material when the guide is positioned above the sheet of material and the sheet is received by the upper surface of the table;

a wire positionable adjacent the upper surface of the table and below the sheet of material when the sheet of material is received by the upper surface of the table, the wire being positioned laterally between said edges and vertically below the gap of the guide when the guide is positioned above the sheet of material; and a shuttle moveably engaging the guide track for pulling the wire upward through the sheet of material and through the gap in the elongate guide to cut the sheet of material along the preselected line.

8. Apparatus as set forth in claim 7 wherein the shuttle includes a guide roller adapted for engaging the guide track to direct the shuttle along the guide and above the preselected line on the sheet of material.

9. Apparatus as set forth in claim 7 wherein the shuttle includes a rotatably mounted sheave for guiding the wire upward through the sheet of material and through the gap in the elongate guide to cut the sheet of material along the preselected line.

10. Apparatus as set forth in claim 9 wherein the sheave has a groove with a rounded bottom extending around the sheave for guiding the wire.

* * * * *